US006330732B1

(12) United States Patent
Liu

(10) Patent No.: US 6,330,732 B1
(45) Date of Patent: Dec. 18, 2001

(54) DUST COLLECT DEVICE FOR AN ERASER

(76) Inventor: Te-Hsi Liu, No. 33, Dong-Hsin Road, Chu-Pei, Hsin-chu (TW)

( * ) Notice: Subject to any disclaimer, the term of this patent is extended or adjusted under 35 U.S.C. 154(b) by 0 days.

(21) Appl. No.: 09/619,387

(22) Filed: Jul. 19, 2000

(51) Int. Cl.[7] ..... A47L 5/38

(52) U.S. Cl. ..... 15/314; 15/326; 15/347; 15/393

(58) Field of Search ..... 15/314, 326, 347, 15/323

(56) References Cited

U.S. PATENT DOCUMENTS

| | | | | |
|---|---|---|---|---|
| 521,258 | * | 6/1894 | Creamer | 15/314 X |
| 995,409 | * | 6/1911 | Lull | 15/393 |
| 1,177,714 | * | 4/1916 | Lull | 15/393 |
| 1,552,713 | * | 9/1925 | Leary | 15/314 X |
| 1,801,620 | * | 4/1931 | Bettman | 15/344 |
| 2,625,703 | * | 1/1953 | Devau | 15/314 X |
| 3,009,188 | * | 11/1961 | Martin | 15/330 |
| 3,238,556 | * | 3/1966 | Martin | 15/330 |
| 3,328,826 | * | 7/1967 | Amos | 15/323 |
| 4,706,326 | * | 11/1987 | Romani | 15/314 |
| 4,729,147 | * | 3/1988 | Armbruster | 15/314 |
| 5,205,013 | * | 4/1993 | Lopes | 15/326 X |
| 5,502,869 | * | 4/1996 | Smith et al. | 15/326 |

* cited by examiner

*Primary Examiner*—Chris K. Moore
(74) *Attorney, Agent, or Firm*—Rabin & Berdo, P.C.

(57) ABSTRACT

The present invention provides a dust collect device for an eraser. It is related to a box, which has an inside box to separate the inside of the box into an inner space and an outer space. An inhaler component is set in the inside box, and it connects the inner space with the outer space. A dust bag, which is ventilated, is placed in the inner space, and it connects a dust guide pipework with the eraser to form a connective structure, so that users can operate the inhaler component at any time to absorb the dust into the dust bag. Thus, the dust is collected instead of floating and spreading in the air, so the environment can stay clean.

6 Claims, 6 Drawing Sheets

DUST COLLECT DEVICE FOR AN ERASER

FIELD OF THE INVENTION

The present invention is related to a dust collecting eraser, especially an improved dust collecting eraser that can rapidly collect the dust when users are erasing boards. Because of this, the environment around the board can stay clean.

DESCRIPTION OF THE INVENTION

The present invention is related to a dust collecting eraser, especially an improved dust collecting eraser that can rapidly collect the dust when users are erasing boards, so that the environment can stay clean.

Usually a blackboard or a whiteboard is set in the teaching place for teachers to write words, content of courses or to explain teaching materials. Some teachers write on the whiteboards with sign pens or whiteboard pens, but the material contained in the pens is a strong poisonous organic solvent, which evaporates easily and may harm one's health; others use chalk, and after writing words on the board for a period of time, they have to erase them with erasers. The dust of the chalk is pressed under the eraser and when the eraser moves, the dust drops and spreads all over. This fills the environment with chalk dust, and the dust may harm the teaching staffs and students, especially teachers and children. Teachers often write on the board with chalk, and when they erase the board, dust comes out and flies everywhere and it may harm ones health. The manufacturer of the eraser should make some improvement in this situation.

Therefore, many schools use chalk in class. Since the dust can severely harm ones health, a need for an improved eraser to fit in with environmental protection and health is present.

Thus, the present invention includes a dust collecting device for an eraser, which includes a box, which has an inside box to separate the inside space of the box into an inner and an outer space. An inhaler component and a ventilated dust bag are collocated. The dust bag is connected to a dust guide pipe work and forms a connective structure, so that users can operate the inhaler component at any time to absorb the dust into the dust bag. Thus, the dust is collected instead of floating and spreading in the air, so the environment can stay clean.

The second aspect of the present invention is related to the inner space of the inside box, in which is a ventilated dust bag. The dust bag is connected to a dust guide pipe work to form a connective structure, so that the dust bag can be easily taken apart from the embodiment.

In order to describe in detail the objects, characteristics and functions of the present invention, an example of an embodiment and figures relevant to the present invention are given as follows:

DETAILED DESCRIPTION OF THE INVENTION

Figure 1:
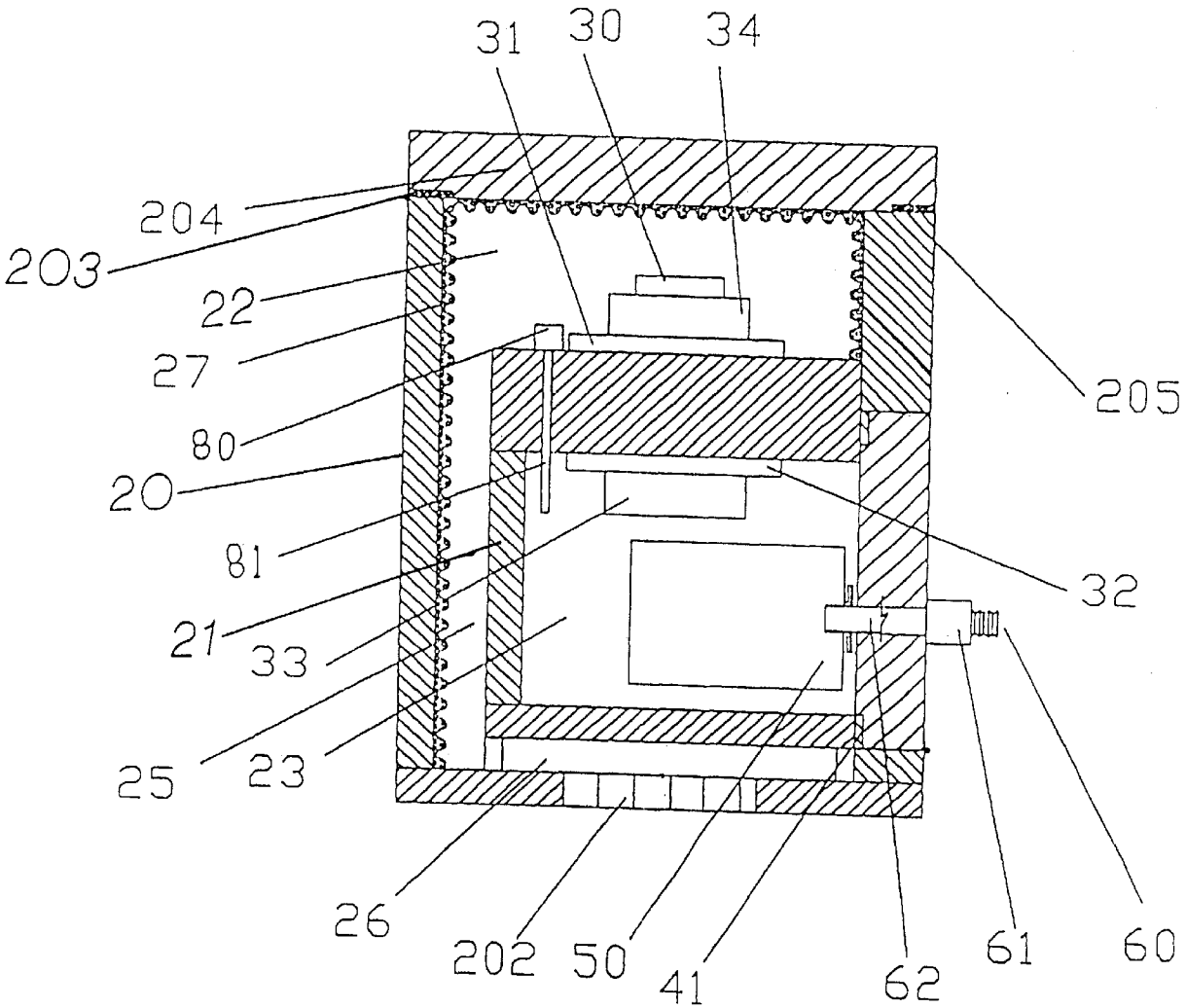
FIG. 1 is the diagrammatic sketch of the entire structure of the first example of the dust collecting device.

The present invention is an example of an embodiment of the dust collecting device (as shown in FIG. 1). It includes an outer box 20, an inhaler component 30, a door leaf 40, a dust bag 50, and a dust guide pipework 60.

The box 20 (as shown in FIG. 1) is fabricated by solidly joining bar sheets. An opening 201 is on its front side and at its bottom side is an air outlet 202. The upper part of the box 20 is hollow, and on its top is a set of hinge 203, and again a cover 204 is on its top. The hinge 203 is solidly joined with the side of the cover 204 and the upper part of the box 20. The top cover 204 can move to open or close the box 20 to allow access to its hollow interior. The inside edge of the front cover 204 has an airtight piece 205, which compresses against the box 20 from an airtight structure. An inside box 21 is fixed in the box 20 and is also fabricated by solidly joined bar sheets. Between the box 20 and the inside box 21 is an outer space 22. An inner space 23 is formed within the inside box 21. The inside box 21 has a front frame 211 solidly joined to the inside edge of the opening 201, and it also has a passage 212 set at the inner side of the front frame 211. The passage 212 connects with the opening 201 of the box 20. The top of the inside box 21 has a round hollow trough (hole) (not shown) to connect the outer space 22 and the inner space 23. Further, a circular groove 25, which is formed and keeps an appropriate interval between the inside box 21 and the box 20, connects to the outer space 22. A bottom-set 26, which is also formed to keep an appropriate interval between the inside box 21 and the box 20, is at the bottom of the inside box 21 and connects the circular groove 25 with the air outlet 202. A soundproof mat 27 is attached to the inside surface of the box 20 and the front cover 204.

The inhaler component 30 (as shown in FIG. 1) is installed in the round hollow trough of the inside box 21. It has two round pedestals 31 and 32 that contact and press the top and bottom sides of the round hollow trough respectively, so that the joints can be airtight. An air suction ring 33 communicating with the inner space 23 is set on the round pedestal 32, which is at the bottom of the inhaler component 30. Further, an air exhaust ring 34 communicating with the outer space 22 is set on the round pedestal 31, which is on the top of the inhaler component 30.

Figure 4:
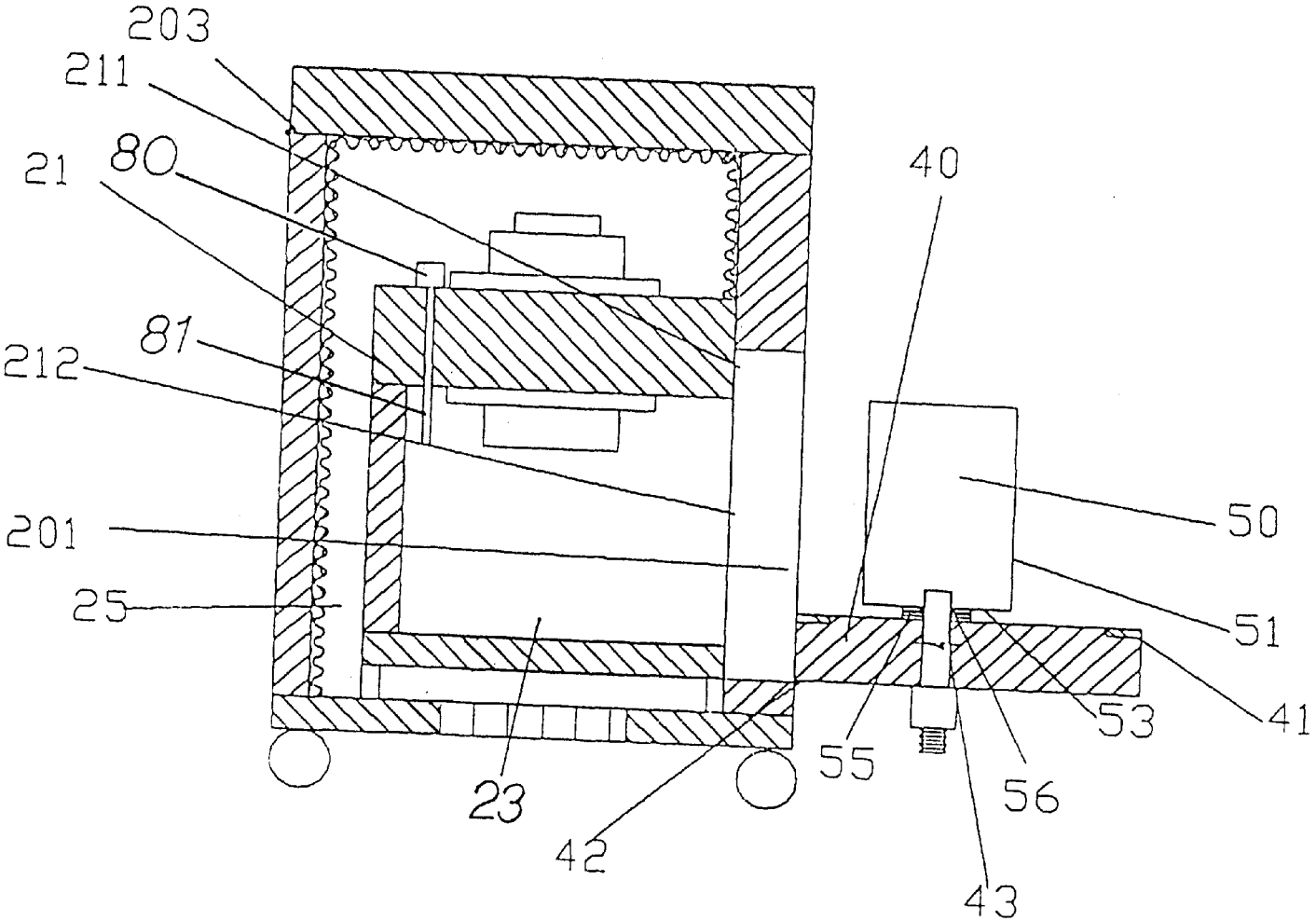
FIG. 4 is a diagrammatic sketch of the example of the dust collecting device showing how the dust bag connects to the dust guide pipe work.

The door leaf 40 (as shown in FIGS. 1 and 4) has a square shape and covers the opening 201 of the box 20. Inside the edge of the door leaf 40 an airtight mat 41 is set, which contacts the pass 212 of the inside box 21. On the side of the door leaf 40 is a hinge 42. The hinge 42 correspondingly solidly joins an edge of the opening 201 of the box 20. The door leaf 40 can be pivoted to be open or closed, and a round hole 43 is in the middle of the door leaf 40.

The dust bag 50 (as shown in FIGS. 1 and 4) includes a filter coat 51, which has tiny meshes in it, and has an appropriate space therein. It can be put in the inner space 23 of the inside box 21. A perforation (not shown) is on one side 53 of the filter coat 51. Surrounding the perforation 54 is a bonding component 55, and this component 55 can be the magic binder (similar to Velcro) we usually buy in the store. The perforation 54 has a soft inner ring 56 therearound.

Figure 3:
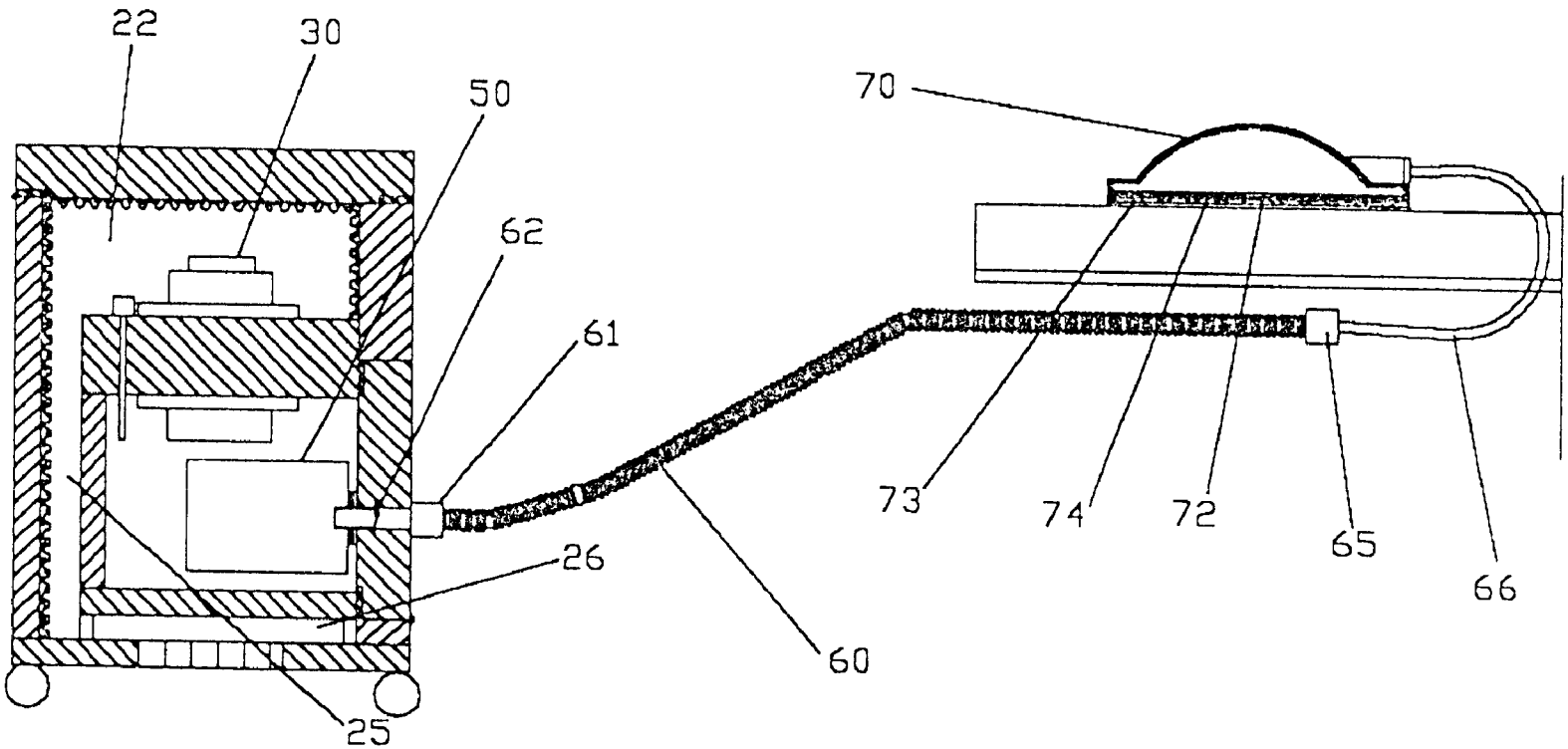
FIG. 3 is a cutaway illustration of the combination of the box and the inside box the example of the dust collecting device.

The dust guide pipework 60 is a serpentine pipe, which is soft and has an appropriate caliber (as shown in FIGS. 1 and 3). One end of the dust guide pipework 60 pivot join with a connection 61. The straight pipe 62 of the connection 61 pierces through the round hole 43 of the door leaf 40. The middle part of the straight pipe 62 has a flange that contacts the inside surface of the inner ring 56 of the round hole 43. On the side of the flange, which corresponds to the bonding component 55, is a bonding component. The bonding components can firmly bond and join each other. The other end of the dust guide pipework 60 connects to a switchover head 65, with which a connecting pipe 66 can join.

Figure 5:
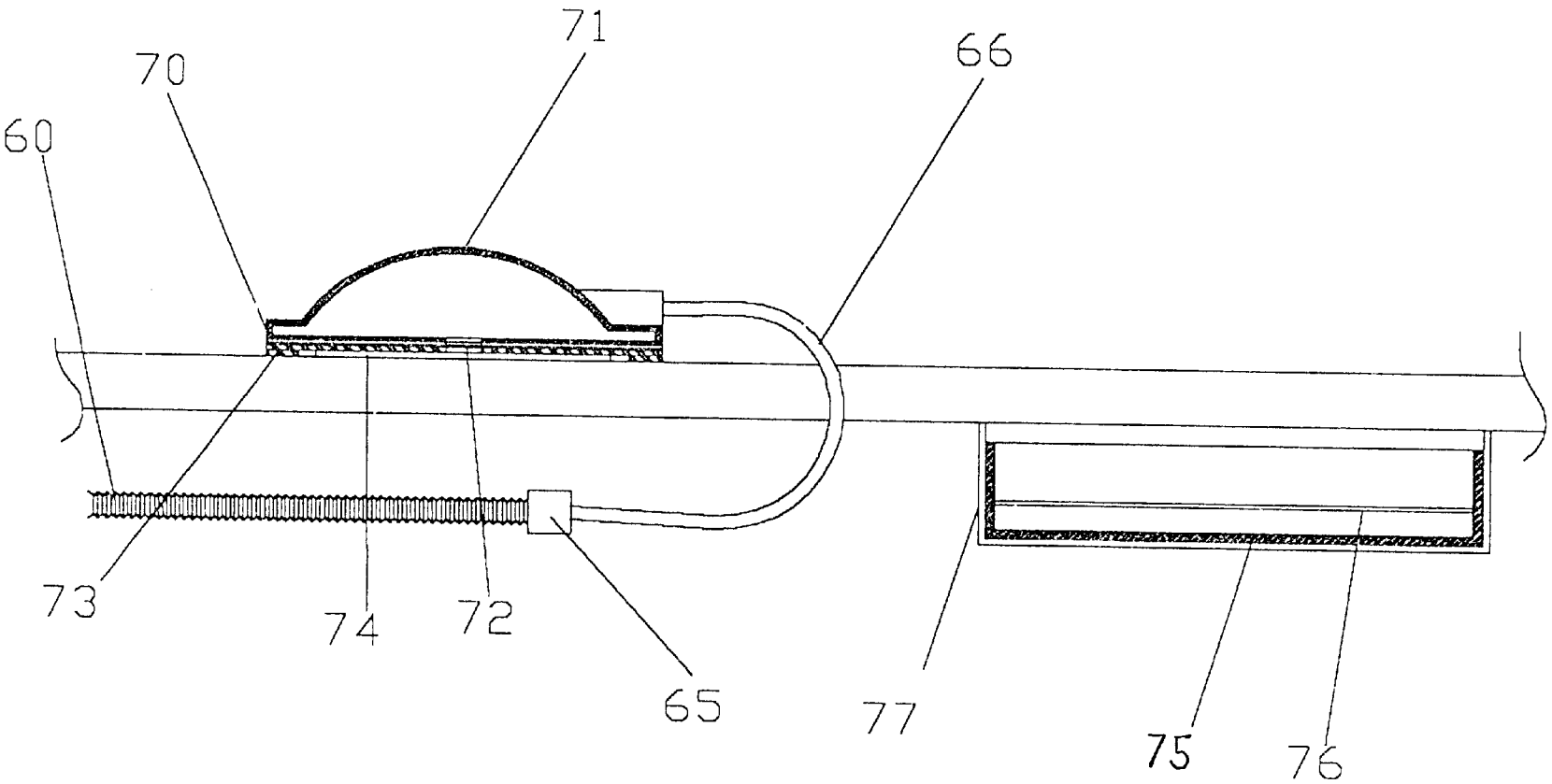
FIG. 5 is a diagrammatic sketch of the example of the dust collecting device showing how the dust bag connects to the dust guide pipework.
Figure 6:
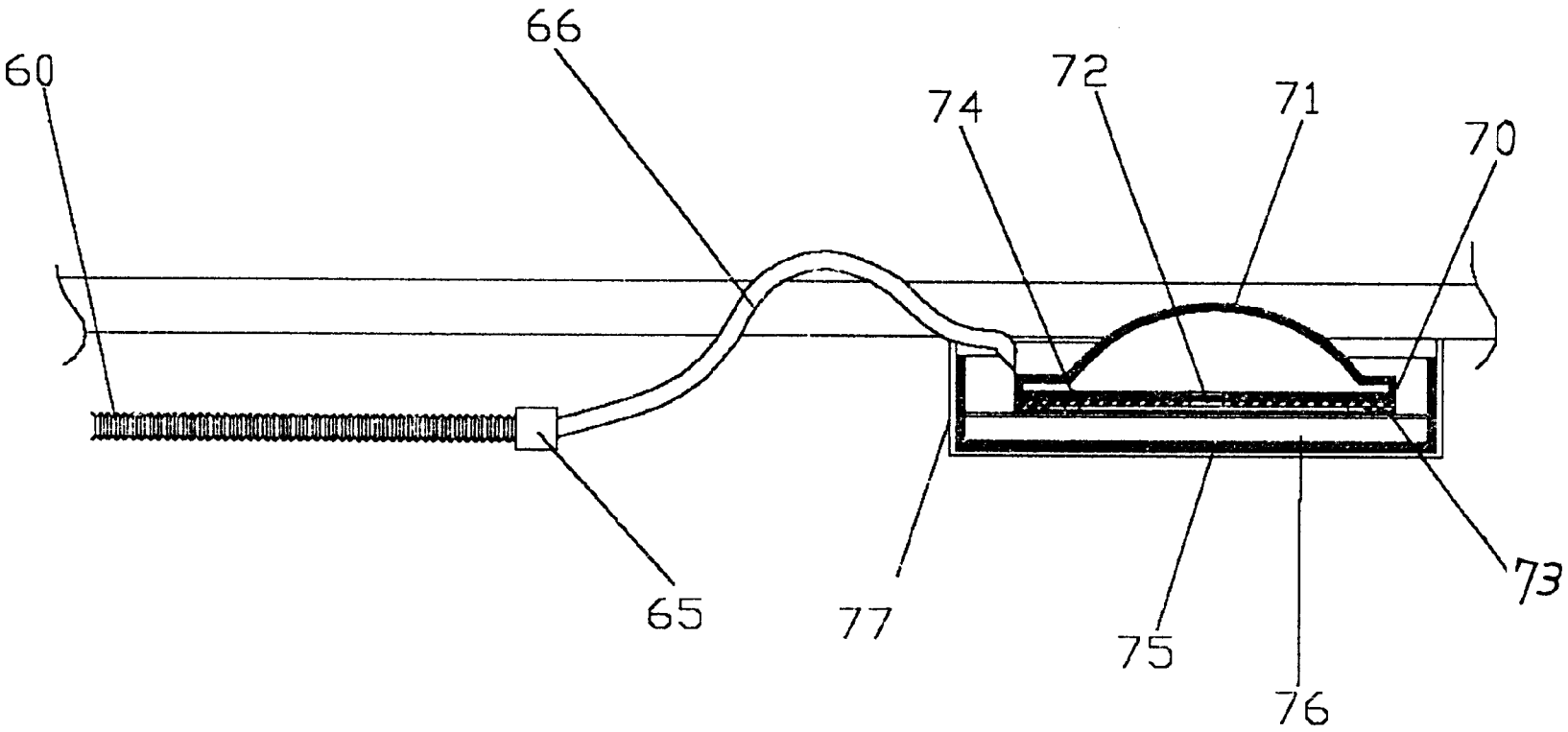
FIG. 6 is a diagrammatic sketch of the example of the present invention showing the placement of the eraser in the dust-cleaning trough.

One side of the eraser 70 (as shown in FIGS. 1, 3 and 5) solidly join with a core case 71, which connects with the connecting pipe 66. The bottom of the core case 71 has connecting holes 72. The core case 71 is attached to a cleaning layer 73, which has multiple grooves 74. The grooves 74 communicate with the connecting holes 72. At the bottom of the other dust-cleaning trough 75 is a dust scraper 76 to contact with the eraser 70, and to scrape the chalk dust. The dust-cleaning trough 75 is set up on a frame 77 and can be pulled out or pushed and hid in.

Figure 2:
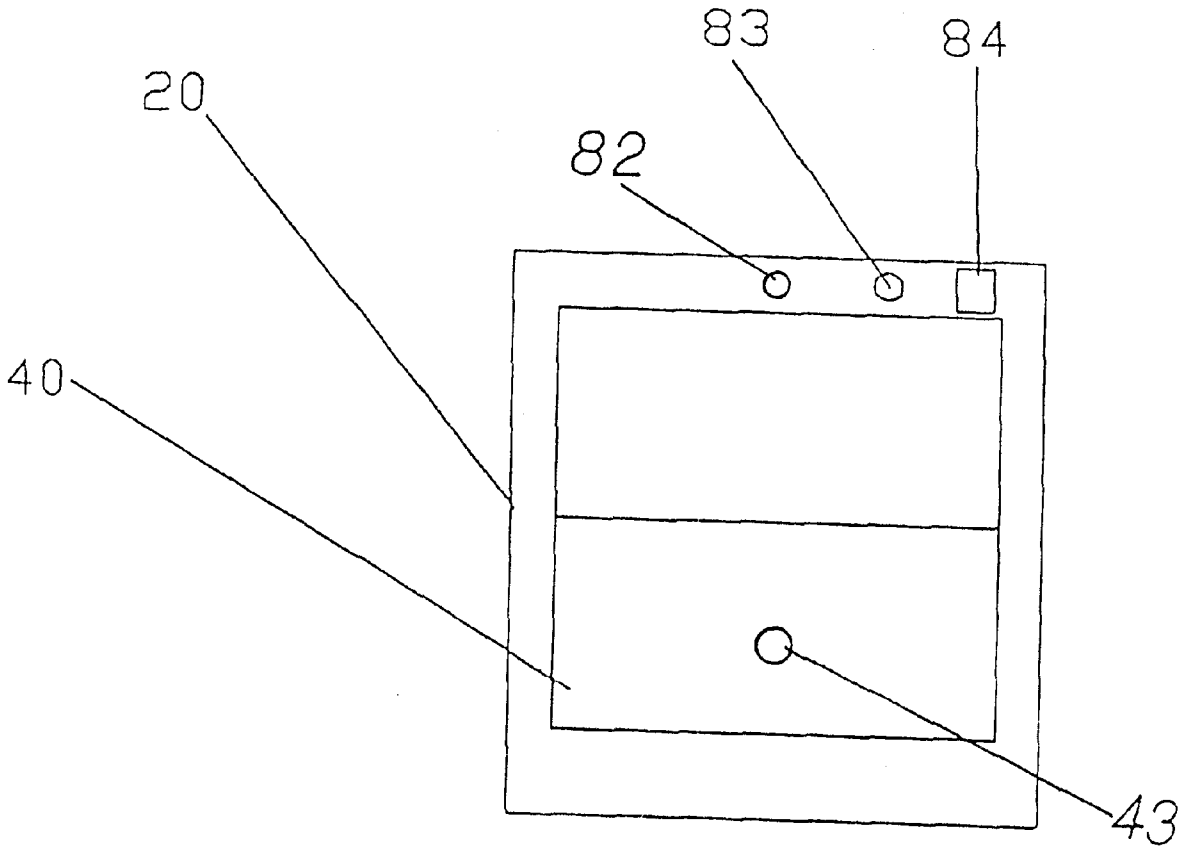
FIG. 2 is the diagrammatic sketch of the box and the inside box of the first example of the dust collecting device.

A sensitive element 80 (as shown in FIGS. 1 and 2) solidly joins with the inside box 21 and is set on the top of the inside box 21 and around the round hollow trough. The sensitive element 80 has a detector bar 81 that pierces through the inside box 21 and protrudes into the inner space 23. The detector bar 81 can test the vacuum. A display lamp 82 is fixed on the front part of the box 20. The display lamp 82 connects with the sensitive element 80 by a conducting wire. An inductance switch 83 and a manual switch 84 correspondingly connect with a power supply and the inhaler component 30. An infrared switch (not shown) may be disposed in the core case 71 of the eraser 70. A turn-on switch (not shown) and a turn-off switch (not shown) may be disposed in the core case 71. The turn-on switch and the turn-off switch correspondingly connect with the infrared switch. Users use the turn-on switch and the turn-off switch to control the infrared switch to turn on or turn off the inductance switch 83, so that the inhaler component 30 is electrified to become activated or disconnected to stop.

According to the above (as shown in FIGS. 1 and 3), the filter coat 51 of the dust bag 50 has tiny meshes on it. It is ventilated, but the dust cannot go through it. The inner space of the dust bag and the inner space 23 are in communication. The inner space, the dust bag, the dust guide pipework and the core case 71 of the eraser 70 are connected, and the groove 74 of the eraser 70 connects with the connecting hole 72. When users use the eraser to clean the words or charts on the board, they hold the core case 71 of the eraser 70 and press the turn-on switch with their fingers. The infrared switch 85 is started and it turns on the inductance switch to start the inhaler component 30. The inhaler component 30 pumps the air from the inner space 23, and the dust bag 50 is ventilated. In the meantime, the inhaler component 30 also pumps air through the dust bag 50. Because the dust guide pipework, the core case 71 of the eraser 70, the groove 74 and the connecting hole 72 are connected, the air is also pumped through them by the inhaler component 30. Dust comes out when the cleaning layer 73 of the eraser 70 cleans the words or charts written by chalk. The dust is pressed between the cleaning layer 73 and the blackboard. The eraser 70 can pump the dust between the cleaning layer 73 and the blackboard to the groove 74. By the connecting structure, the dust is led by the dust guide pipework to the inner space of the dust bag 50.

As shown in FIGS. 1 and 4, the dust is pumped into the space of the dust bag 50. Because the filter coat 51 is ventilated, the dust cannot go through it, but instead the dust is gathered in the inner space of the dust bag 50. The inhaler component 30 directly pumps the dust when the eraser 70 of the present invention cleans the words or charts. Because of this, the dust coming from the eraser 70 does not spread and fly. The environment around the board can stay clean.

As shown in the FIG. 3, when the dust accumulats in the inner space of the dust bag 50, the filter coat 51 becomes covered with dust, so that the meshes are partly clogged or the meshes become smaller and smaller. In order to keep the amount of air the inhaler component 30 pumps consistent or sufficient, the inhaler component 30 adjusts its output power using an internal control system. If the inhaler component 30 can pump appropriate air through the dust bag 50, and the inner space 23 can keep its vacuum set, the inhaler component 30 can maintain a stable pumping.

As shown in FIGS. 3 and 4, when the dust bag 50 accumulates a large amount of the dust and the filter coat 51 becomes clogged to a set level, the air leaving the dust bag 50 will be less than a set level as the inhaler component 30 pumps. In this case, the ability to pump dust becomes lower. The inhaler component 30 pumps the air from the inner space 23, so that the vacuum is raised. At this time, the detector bar 81 of the sensitive element 80 pierces into the inner space 23. When the vacuum value that it detects is higher than a set value, the sensitive element 80 will give the display lamp 82 a signal through a conducting wire. The display lamp 82 glistens, so that users will know that the dust in the dust bag 50 is accumulated to a limit. It reminds users to clean the dust or to change to a new dust bag.

When users want to change or clean the dust in the dust bag 50, they can open the door leaf from the opening 201 of the box 20. The passage 212 becomes accessible, and the inner space 23 of the inside box 21 is open. The dust bag 50 is connected with the bonding agents of the connection 61 by magic binder. The bonding agents can be easily taken apart. Users can easily take out the dust bag 50 to clean the dust inside. When users are going to change or put back the dust bag 50, they only have to match the perforation of the dust bag 50 and the straight pipe of the connecting 61. Then, the inner ring 56 is joined to the straight pipe 62. The inner ring 56 is soft, so that when it joins with the straight pipe 62, it becomes airtight. When users bind the bonding agents, the bag will be back in place and ready for use. It is easy for adults and children to operate.

When the inhaler component 30 pumps the air in the inner space 23, the air goes in through air suction uing 33 and out through the exhaust ring 34 to be discharged to the outer space 22 of the box 20. The air goes through the circular groove 25, the bottom-set 26 and at last goes out through the air outlet 202. Soundproof pads 27 are set on the inner surfaces of the cover 204. The inhaler component 30 makes some noise when it pumps air. The soundproof pads 27 can isolate the noise. Further, the circular groove 25 and the bottom-set 26 between the box 20 and the inside box 21 form an extended pass to effectively isolate the sound. So, it will not make noticeable noise when it is operated.

When users clean the words or charts on the blackboard, they press the turn-on switch with their fingers. The infrared switch is started and it urns on the inductance switch to start the inhaler component 30. When it cleans the board, it starts to pump the dust. This make the environment around the board clean and it is good for children's health. After the eraser 70 has cleaned the board for a period of time (as shown in FIG. 5), the surface of the cleaning layer 73 becomes covered with dust. Users can put the eraser 70 into the dust-cleaning trough. The bottom of the cleaning layer 73 can touch the dust scraper 76. When moved relatively, the scraper 76 scrapes the dust from layer 73. A magic binder can bind the eraser 70 and the cleaning layer 73, so that users can replace the cleaning layer 73 very easily.

To conclude, the present invention provides a dust collecting device for an eraser. It is related to a box, which has an inside box to separate the inside of the box into an inner and an outer space. An inhaler component is set in the inside box, and it connects the inner space with the outer space. A dust bag, which is ventilated, is placed in the inner space, and it connects a dust guide pipework with the eraser to form a connective structure, so that users can operate the inhaler component at any time to absorb the dust into the dust bag. Thus, the dust is collected instead of floating and spreading in the air, so the environment can stay clean.

The embodiment mentioned above is only one example to embody the present invention, and cannot restrict the range of embodiment of the present invention to it. Any modification or change made based on the present invention shall be considered to be within the coverage of the present invention.

What is claimed is:

1. An improved dust collecting device for an eraser, comprising:

an outer box having a first space therein, and having an air outlet that communicates an outside of said box with the first space;

an inner box that is smaller than the first space and being fixed within the first space of said outer box so as to define from the first space an outer space located within said outer box and outside of said inner box, said inner box having an inner space, and having a hole that communicates the outer space with the inner space, said inside box further having a passage that leads into the inner space;

an inhaler component disposed in the hole, and having an air suction ring and an air exhaust ring respectively disposed in the inner space and the outer space;

a door leaf that is pivotally connected to said outer box, and being pivotal to a closed position where the door leaf covers the passage into the inner space and contacts said inner box to form an airtight seal, said door leaf being pivotal to an open position where the passage is not covered by said door leaf, said door leaf having a hole therethrough;

a ventilated dust bag adapted to prevent the passage of dust therethrough, said dust bag being disposed in the inner space of said inner box, said dust bag having a perforation, and a bonding component disposed around the perforation;

a connection assembly extending through the hole in said door leaf and having one end projecting into said dust bag via the perforation, and having another end, said dust bag being connected to said connection assembly using said bonding component; and a dust guide pipe work, one end of which is joined to the another end of said connection assembly, another end of said dust guide pipe work being connectable with an eraser;

wherein when said inhaler component is activated, air is drawn from the inner space into said outer space, causing air to be sequentially drawn through said dust guide pipe work, said connection assembly and said ventilated dust bag, so that dust can be collected in said dust bag.

2. The dust collecting device recited in claim 1, further comprising a sound proof mat disposed on an inner wall of said outer box.

3. The dust collecting device recited in claim 1, further comprising means for detecting an increased vacuum level in the inner space.

4. In combination, a dust collecting device, comprising:

an outer box having a first space therein, and having an air outlet that communicates an outside of said box with the first space;

an inner box that is smaller than the first space and being fixed within the first space of said outer box so as to define from the first space an outer space located within said outer box and outside of said inner box, said inner box having an inner space, and having a hole that communicates the outer space with the inner space, said inside box further having a passage that leads into the inner space;

an inhaler component disposed in the hole, and having an air suction ring and an air exhaust ring respectively disposed in the inner space and the outer space;

a door leaf that is pivotally connected to said outer box, and being pivotal to a closed position where the door leaf covers the passage into the inner space and contacts said inner box to form an airtight seal, said door leaf being pivotal to an open position where the passage is not covered by said door leaf, said door leaf having a hole therethrough;

a ventilated dust bag adapted to prevent the passage of dust therethrough, said dust bag being disposed in the inner space of said inner box, said dust bag having a perforation, and a bonding component disposed around the perforation;

a connection assembly extending through the hole in said door leaf and having one end projecting into said dust bag via the perforation, and having another end, said dust bag being connected to said connection assembly using said bonding component; and a dust guide pipe work, one end of which is joined to the another end of said connection assembly; and an eraser connected with an another end of said dust guide pipe work;

wherein when said inhaler component is activated, air is drawn from the inner space into said outer space, causing air to be sequentially drawn through said eraser, said dust guide pipe work, said connection assembly and said ventilated dust bag, so that dust from the eraser can be collected in said dust bag.

5. The combination recited in claim 4, wherein said dust collecting device further comprises a sound proof mat disposed on an inner wall of said outer box.

6. The combination recited in claim 4, wherein said dust collecting device further comprises means for detecting an increased vacuum level in the inner space.

* * * * *